US005301879A

United States Patent [19]

Takeda et al.

[11] Patent Number: 5,301,879

[45] Date of Patent: Apr. 12, 1994

[54] FUEL INJECTION DEVICE FOR AN INTERNAL COMBUSTION ENGINE

[75] Inventors: Keiso Takeda; Tomojiro Sugimoto, both of Mishima, Japan

[73] Assignee: Toyota Jidosha Kabushiki Kaisha, Toyota, Japan

[21] Appl. No.: 890,682

[22] Filed: May 29, 1992

[30] Foreign Application Priority Data

Jun. 6, 1991 [JP] Japan ..... 3-160787

[51] Int. Cl.[5] ..... B05B 7/12

[52] U.S. Cl. ..... 239/408; 239/432; 239/433; 239/429; 239/524

[58] Field of Search ..... 239/409, 416, 432, 433, 239/533.3, 533.12, 585.1-585.5, 590, 524, 407, 408, 412, 429, 417.3

[56] References Cited

U.S. PATENT DOCUMENTS 1,306,458 6/1919 Anderson ..... 239/432
3,429290 12/1975 Tallarovic ..... 239/432 X
4,657,189 4/1987 Iwata et al. ..... 239/585
4,771,948 9/1988 Fukukawa et al. ..... 239/585.4 X
4,982,716 1/1991 Takeda et al. ..... 123/531
5,035,358 7/1991 Katsuno et al. ..... 239/409 X

FOREIGN PATENT DOCUMENTS 62-101065 6/1987 Japan .

*Primary Examiner*—Andres Kashnikow
*Assistant Examiner*—Kevin P. Weldon
*Attorney, Agent, or Firm*—Kenyon & Kenyon

[57] ABSTRACT

A fuel collision surface 40 is provided so as to be spaced from and axially opposite to a fuel injection port 14. A ratio of a width of the fuel collision surface 40 to a diameter of the fuel injection port 14 is set in the range of 0.2–0.3 so that fuel flows in a membrane-like pattern in branch ports 34 without attaching to the branch port surfaces and is effectively atomized. Further, it is desirable that an angle defined between an air injection passage 36 and a fuel injection valve axis is set in the range of 45°–75° so that a good air atomization due to air injection is obtained.

5 Claims, 5 Drawing Sheets $\phi D_2^2/\phi d^2 = 3.83$ $a/\phi d = 0.25$ $\phi D_2^2/\phi d^2 = 3.83$ $a/\phi d = 0$

FUEL INJECTION DEVICE FOR AN INTERNAL COMBUSTION ENGINE

BACKGROUND OF THE INVENTION

1. Field of the Invention

The present invention relates to a two hole, air assist type fuel injection device used in an internal combustion engine having two intake valves per cylinder.

2. Description of the Prior Art

Current internal combustion engines for automobiles tend toward a design having two intake valves, two exhaust valves, and an electronically controlled fuel injection devices per cylinder (a four valve EFI engine) for the purpose of realizing high response, minimizing air pollution, and improving fuel economy.

Japanese Utility Model Publication SHO No. 63-19874 (U.S. Pat. No. 4,982,716) proposes a fuel injection device for this type of engine having a fuel injection valve and an adapter coupled to the fuel injection valve. More particularly, the fuel injection valve has a fuel injection port for injection of fuel therethrough. The adapter has a concave portion defining a dead space therein, a fuel collision surface having a width larger than the diameter of the fuel injection port of the fuel injection valve and allowing the fuel from the fuel injection port to collide with the fuel collision surface to thereby change its flow direction, two branch port means formed on sides of the fuel collision surface for allowing the fuel to pass through the branch ports, and two air injection passages, opening to the dead space, for injecting air against the fuel above the fuel flow to promote atomization of the fuel.

However, in the fuel injection device having the fuel collision surface and the air injection ports, the atomization of fuel is greatly affected by the structure of the fuel injection device, for example, the sizes of the fuel collision surface and the fuel injection port and the angle of the air injection passages. Therefore, for the purpose of attaining a high grade of fuel atomization, an optimum structure should be developed.

SUMMARY OF THE INVENTION

An object of the invention is to provide a fuel injection device for an internal combustion engine having an optimum structure to attain a high grade of fuel atomization to thereby effectively suppress air pollution and to improve fuel economy.

In accordance with the present invention, the above-described object is attained, by a fuel injection device for an internal combustion engine that has a fuel injection valve with a fuel injection port and an adapter including a fuel dividing wall with a fuel collision surface and two branch ports disposed so that a stream of fuel from the fuel injection port collides with the fuel collision surface and then splits to pass through the branch ports, and two air injection passages for injecting air against the fuel, wherein the following relationship holds between a width a of the fuel collision surface and a diameter d of the fuel injection port:

$$0.2 \leqq a/d \leqq 0.3.$$

The following relationship may further hold for an angle $\theta$ defined between the axis of each air injection passage and the axis of the fuel injection valve:

$$45° \leqq \theta \leqq 75°.$$

In the thus constructed fuel injection device, since the a/d value is determined to be in the range 0.2–0.3, the fuel is prevented from attaching to the surfaces of the branch ports. As a result, the fuel flows in a membrane-like manner in the branch ports to decrease in thickness in accordance with the continuity equation so as to be effectively atomized.

When the $\theta$ value is set at 45°–75°, air injected from the air injection passages well atomizes the fuel substantially independently of the amount of air injected. As a result, even under a condition in which the pressure difference between an inlet and an outlet of each air injection passage is small, such as in a throttle valve full opening condition, an effective atomization can be maintained.

BRIEF DESCRIPTION OF THE DRAWINGS

The above and other objects, features, and advantages of the present invention will become more apparent and will be more readily appreciated from the following detailed description of the preferred embodiments of the invention taken in conjunction with the accompanying drawings, in which.

DETAILED DESCRIPTION OF THE PREFERRED EMBODIMENTS

Figure 1:
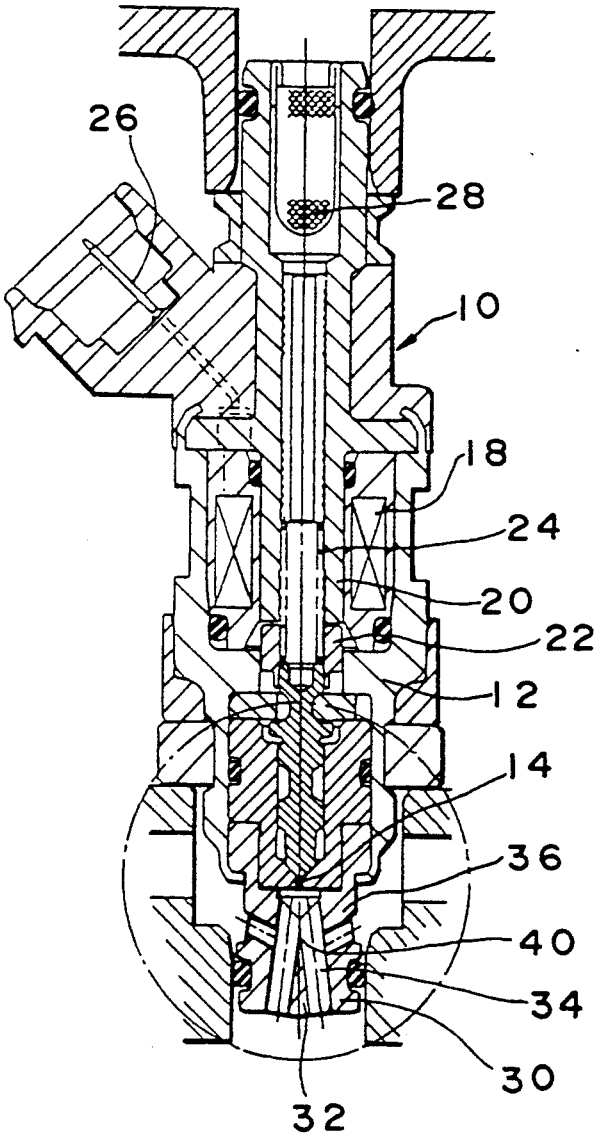
FIG. 1 is a cross-sectional view of a fuel injection device for an internal combustion engine in accordance with one embodiment of the present invention.

FIG. 1 illustrates an air assist-type, two port fuel injection device for an internal combustion engine in accordance with one embodiment of the invention. As illustrated in FIG. 1, the fuel injection device has a fuel injection valve 10 having a longitudinal axis and an adapter 30 coaxially coupled to the fuel injection valve 10.

The fuel injection valve 10 includes a body 12 which includes a single fuel injection port 14, formed in a lower end portion of the body 12, for metering fuel and injecting fuel therethrough. Within the body 12, the fuel injection valve 10 includes a needle valve 12 movable in an axial direction of the fuel injection valve 10 and a magnet coil 18 wound around a fixed core 20 for driving the needle valve 12 so as to open and close the fuel injection port 14. More particularly, the fuel injection valve 10 includes a movable core 22 and a spring 24. The movable core 22 contacts or couples with the needle valve 12 so as to be able to drive the needle valve 12 in the axial direction of the fuel injection valve 10. The fixed core 20 is disposed so as to oppose the movable core 22 and magnetically attracts the movable core 22 together with the needle valve 12 in the axial direction of the fuel injection valve 10 when electric current is supplied to the magnet coil 18, to open the fuel injection valve 10 and to inject fuel. The spring 24 contacts one end of the movable core 22 so as to bias the movable core 22 in a direction away from the fixed core 20. In contrast, when supply of electric current to the magnet coil 18 is stopped, the spring 24 moves the movable core 22 and the needle valve 12 in the direction away from the fixed core 20 to close the fuel injection valve 10 and to stop fuel injection. The fuel injection valve 10 further includes a fuel filter 28 disposed in a fuel path formed in the body 12.

Figure 2:
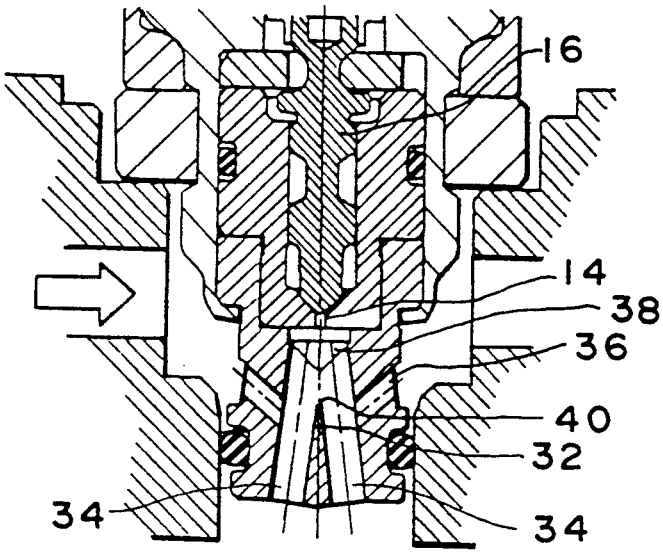
FIG. 2 is a partial, enlarged view of an adapter and a portion in the vicinity of the adapter of the fuel injection device of FIG. 1.

As illustrated in FIG. 2, the adapter 30 includes a fuel dividing wall 32 for dividing the fuel from the fuel injection port 14 of the fuel injection valve 10 into two portions, two branch ports 34, formed on sides of the fuel dividing wall 32, for allowing the fuel divided by the fuel dividing wall 32 to pass through the branch ports 34, and two air injection passages 36, each having an axis extending inwardly and downwardly and opening to each of the two branch ports 34, for injecting air against the fuel passing through the branch ports 34 from above the fuel flow to promote atomization of fuel.

Figure 3:
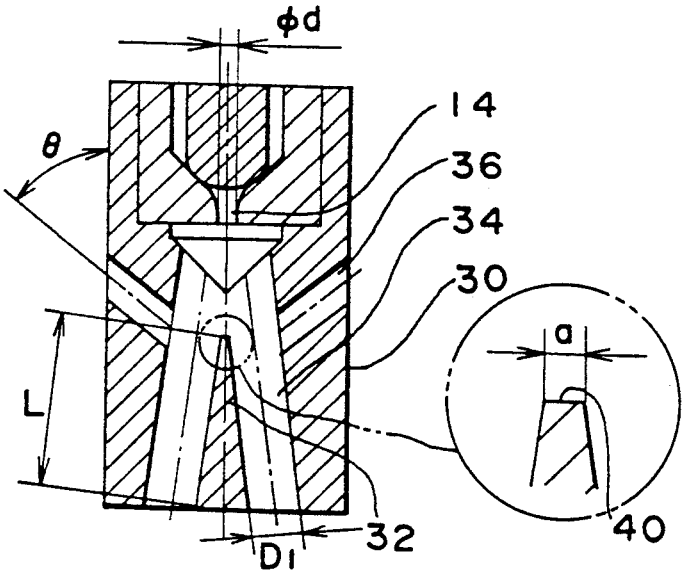
FIG. 3 is an enlarged view of the adapter of the fuel injection device of FIG. 1.

The fuel dividing wall 32 has a fuel collision surface 40 at a top of the fuel dividing wall 32. The fuel collision surface 40 is flat and perpendicular to the axis of the fuel injection valve 10 as shown in FIG. 3. The fuel collision surface 40 is spaced from and coaxially opposite to the fuel injection port 14 of the fuel injection valve 10 so that the fuel flowing from the fuel injection port 14 of the fuel injection valve 10 toward the fuel collision surface 40 collides with the fuel collision surface 40 and is divided by the fuel collision surface 40 into two portions.

The adapter 30 has a concave portion defining a dead space 38 therein. The dead space 38 has a side surface with a transverse circular cross section and a bottom with a longitudinal conical cross section. The dead space 38 is located beneath the fuel injection port 14. The fuel collision surface 40 is located below the bottom surface of the dead space 38. Upper ends of the two branch ports 34 open to the bottom of the dead space 38. The volume of the dead space 38 is determined such that fuel injection through the fuel injection hole 14 is stabilized.

Each air injection passage 36 opens into each branch port 34 at a location downstream of the bottom of the dead space 38. Air is injected through each air injection passage 36 due to the pressure difference (DELTA P) between an inlet and an outlet of the air injection passage 36. The injected air collides the fuel flow flowing in a membrane-like pattern within each branch port 34 after the fuel collides with the fuel collision surface 40.

To effectively atomize fuel before the fuel flows out of the adapter 30, as shown in FIG. 3, the following structural relationship holds between the fuel collision surface 40 and the fuel injection port 14:

$$0.2 \leqq a/d \leqq 0.3$$

where, a is a width of the fuel collision surface 40 measured in the direction perpendicular to the fuel injection valve axis and measured in a plane including the axes of the two branch ports 34, and d is a diameter of the fuel injection port 14.

Figure 7:
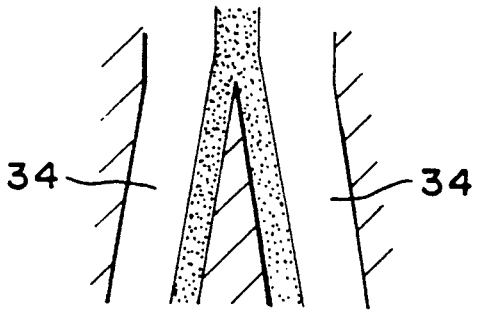
FIG. 7 is a partial cross-sectional view of the adapter illustrating a fuel flowing pattern in a case where the ratio a/d is smaller than 0.2.
Figure 9:
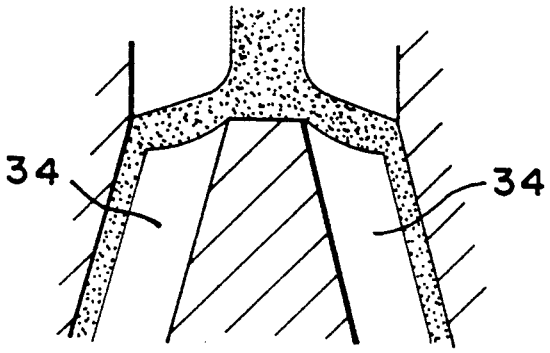
FIG. 9 is a partial cross-sectional view of the adapter illustrating a fuel flowing pattern in a case where the ratio a/d is larger than 0.3.

The reason for providing the limits 0.2 and 0.3 will be explained. If the a/d value were smaller than 0.2, the fuel flow pattern would be as shown in FIG. 7. In this flow pattern, the fuel would attach to a portion of each branch port surface closest to the axis of fuel injection valve 10 and would flow in a slug-like pattern, so that it would be difficult to atomize the fuel. Contrarily, if the a/d value were larger than 0.3, the fuel flow pattern would be as shown in FIG. 9. In this flow pattern, the fuel would have a large change in its direction toward a portion of each branch port surface furthest from the axis of the fuel injection valve 10. Such a fuel flow would also attach to the portions of the branch port surfaces furthest from the axis of the fuel injection valve to flow in a slug-like pattern, so that it would be difficult to atomize fuel.

Figure 8:
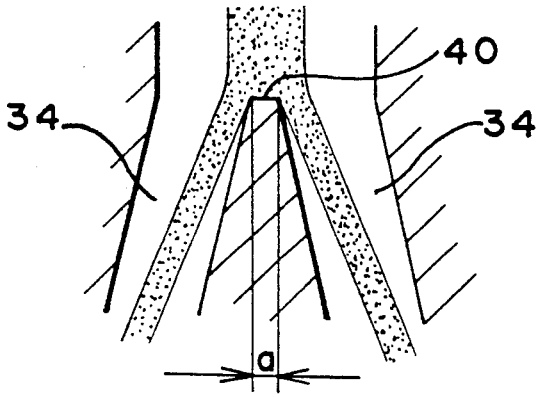
FIG. 8 is a partial cross-sectional view of the adapter illustrating a fuel flowing pattern in a case where the ratio a/d is at 0.2–0.3.

However, in the present invention, since the a/d value is selected to be at 0.2–0.3, the fuel flows in the pattern shown in FIG. 8. In this instance, since the fuel from the fuel injection hole 14 collides with the fuel collision surface 40 having an appropriate width to be divided and spread with an appropriate angle, the fuel flows in the branch ports 34 in a membrane-like pattern almost without attaching to the branch hole surfaces and directly flows out of the branch holes 34. The fuel spreading and flowing in a membrane-like pattern will gradually decrease in thickness in accordance with the continuity equation and will be broken into drops to be atomized. Further, the air injected from the air injection passages 36 collides with the fuel flowing within the branch ports 34 so that fuel atomization is promoted due to the collision of the air with the fuel.

Figure 4:
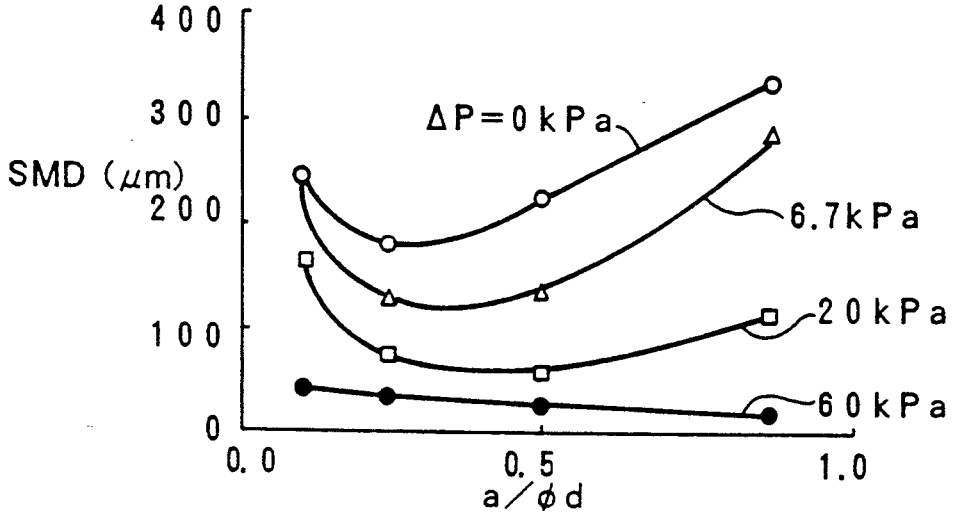
FIG. 4 is a graph illustrating a relationship between an average fuel drop diameter SMD and a ratio a/d of a fuel collision surface width to a fuel injection port diameter.

FIG. 4 illustrates a relationship between an average fuel drop diameter or a size of a medium fuel drop (SMD) and a ratio (a/d) of a width of the fuel collision surface 40 to a diameter of the fuel injection hole 14. When the pressure difference (DELTA P) between the pressures at the inlets and the outlets of the air injection ports 36 is relatively large, the SMD value is substantially constant independently of the a/d value, because the fuel atomization effect due to the injected air is large. However, when the pressure difference (DELTA P) is relatively small, the fuel atomization due to the injected air is small and fuel atomization is largely affected by the a/d value. From FIG. 4, it can be seen that the SMD value is small; that is, the fuel is effectively atomized when the a/d value is in the range of 0.2–0.3. The reason is that the fuel tends not to attach to the branch port surfaces when the a/d value is in the range of 0.2–0.3.

Figure 5:
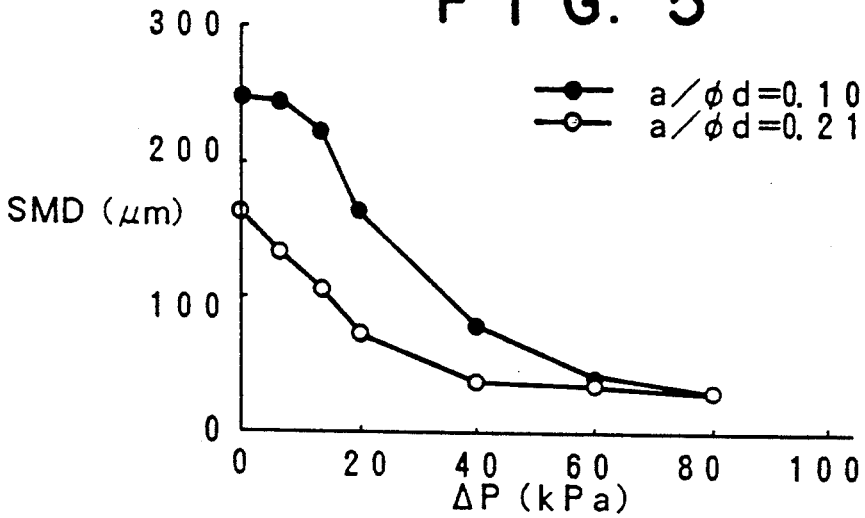
FIG. 5 is a graph illustrating relationships between an average fuel drop diameter SMD and a pressure difference DELTA P between an inlet and an outlet of an air injection passage in the cases where the ratio a/d is 0.1 and the ratio a/d is 0.21.

FIG. 5 illustrates relationships between the SMD value and the DELTA P value in a case where the a/d value is equal to 0.21 (included in the present invention) and in a case where the a/d value is equal to 0.1 (not included in the present invention). From FIG. 5, it can be seen that fuel atomization is more promoted in the present invention than in the case where the a/d value is 0.1, because the fuel collides with a wider fuel collision surface and is spread to flow in a membrane-like pattern. The difference between the two characteristic lines of FIG. 5 shows the fuel atomization effect due to the collision with a wider fuel collision surface.

Figure 6:
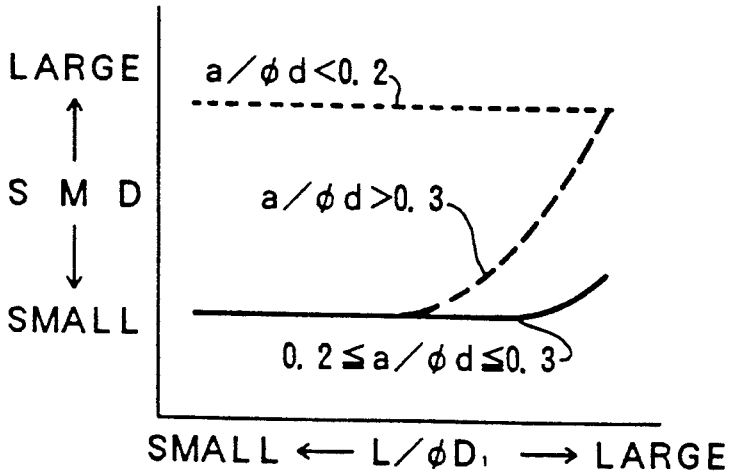
FIG. 6 is a graph illustrating a relationship between an average fuel drop diameter SMD and a ratio $L/D_1$ of a branch port length to a branch port diameter.

Whether the fuel flow attaches to the branch port surfaces is affected by a ratio of a branch port length L to a branch port diameter $D_1$. FIG. 6 illustrates a relationship between the average fuel drop diameter SMD and the ratio $L/D_1$. In a case where a/d is smaller than 0.2, SMD is large and substantially constant independently of a change in $L/D_1$, because fuel flow attaches to the surface portion of each branch port closest to the fuel injection valve axis. In a case where a/d is larger than 0.3, SMD begins to be large from a relatively small L value, because fuel attaches to the surface portion of each branch port furthest from the fuel injection valve axis. In a case where a/d is at 0.2–0.3, SMD is small in a relatively large range of a/d where a stable fuel atomization is obtained almost independently of the values of L and $D_1$.

The direction of the air injection also affects fuel atomization. More particularly, an angle $\theta$ defined between the axis of each air injection passage 36 and the axis of the fuel injection valve 10 is set to be equal to or greater than 45° and to be equal to or smaller than 75°. The reason will be understood from FIGS. 10 and 11 which illustrate how the air injection angle affects the average fuel drop diameter SMD. In this instance, FIG. 10 relates to a case where the a/d value is equal to 0.25 (included in the present invention) and FIG. 11 relates to a case where the a/d value is equal to 0 (not included in the present invention).

In the case where the a/d value is equal to 0, the SMD value tends to increase according to an increase in the $\theta$ value. In contrast, in the case where the a/d value is equal to 0.25, the SMD value is small in the 45°–75° $\theta$ value range. The limits are determined from the following reasons. If the $\theta$ value were selected to be smaller than 45°, a component of the air injection perpendicular to the fuel flow direction would be small so that the air injection would have little effect on fuel atomization. In contrast, if the $\theta$ value were selected to be larger than 75°, a component of the air injection opposed to the fuel flow direction would be generated and such opposite air injection would deteriorate the fuel flow to cause the fuel to attach to the branch port surfaces.

Operation of the fuel injection device having the above-described structures will now be explained.

The fuel injected from the fuel injection port 14 of the fuel injection valve 10 flows in a slug-like pattern and collides with the fuel collision surface 40 to split the flow direction toward the branch ports 34. The fuel is divided into two portions by the dividing wall. The divided fuel flows in the branch ports 34 in a membrane-like pattern and gets thinner to be atomized. The air injected through the air injection passages 36 collides with the fuel of the membrane-like pattern to promote the fuel atomization within the branch ports 34. The atomized fuel flows out of the adapter 30 together with the injected air into the intake ports of the engine cylinder.

In this instance, since the a/d value is set between 0.2 and 0.3, the fuel flows in the pattern shown in FIG. 8. In the flow, fuel is atomized due to collision with the fuel collision surface 40, breakage of the fuel membrane according to the continuity equation, and collision of air injected through the air injection passages 36 with the fuel.

When the intake negative pressure is close to atmospheric pressure at a full open throttle valve condition so that the pressure difference between the inlet and the outlet of the air injection hole 36 is small, fuel atomization due to the injected air is small (see FIG. 4). However, since the a/d value is set between 0.2 and 0.3, fuel atomization due to collision of fuel with the fuel collision surface 40 is maintained effectively even in such a low pressure difference condition.

Figure 10:
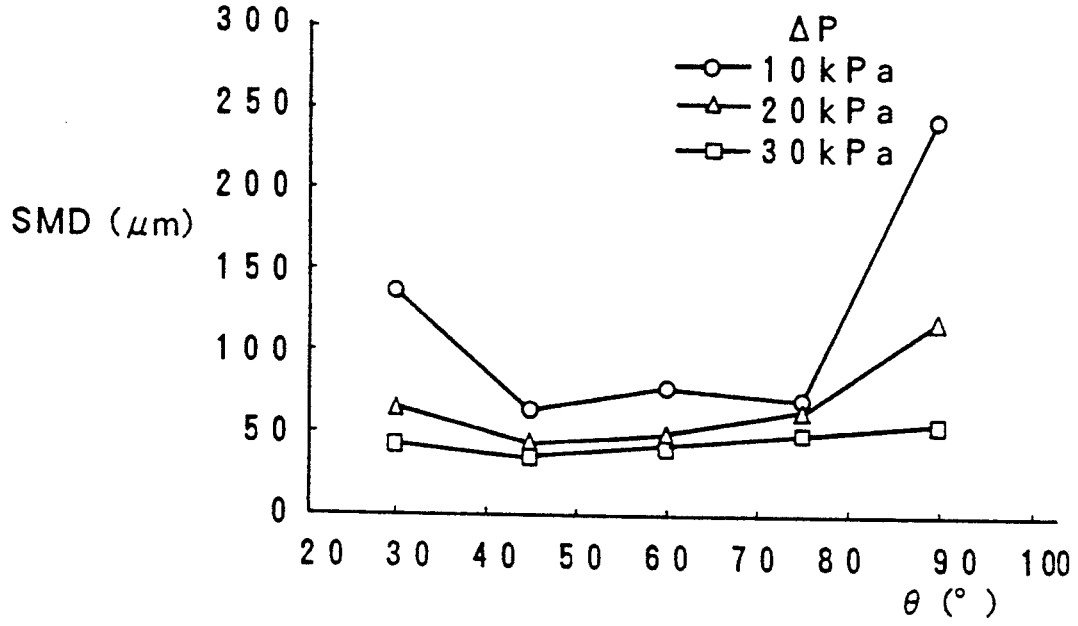
FIG. 10 is a graphical representation of an average fuel drop diameter SMD versus air injection passage angle $\theta$ characteristic in a case where the ratio a/d is equal to 0.25.
Figure 11:
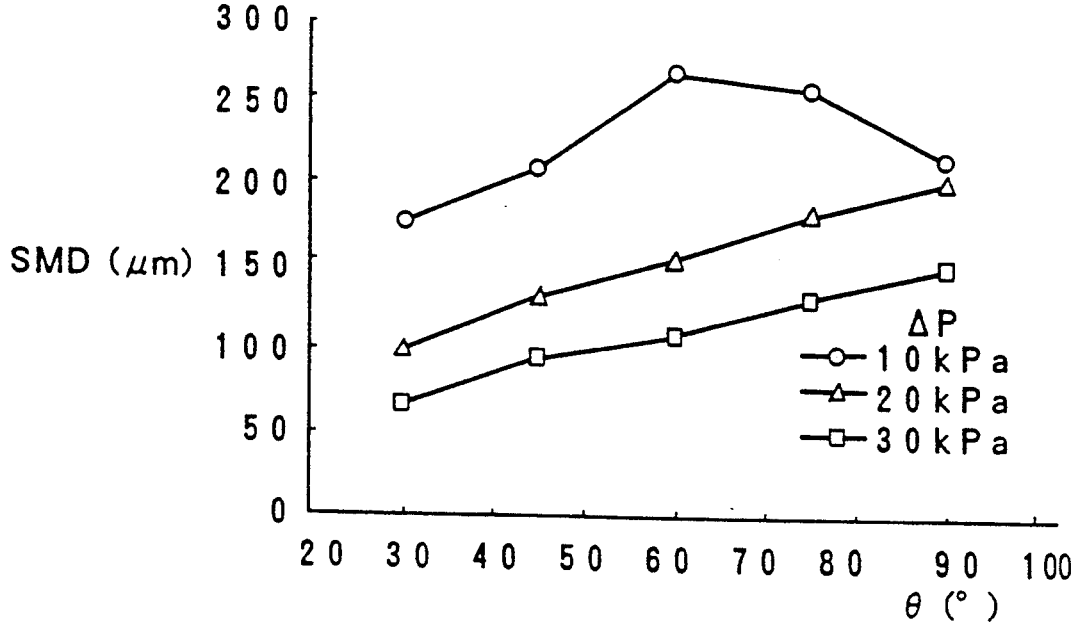
FIG. 11 is a graphical representation of an average fuel drop diameter SMD versus air injection passage angle $\theta$ characteristic in a case where the ratio a/d is equal to 0.

Further, since the angle of each air injection passage 36 with respect to the fuel injection valve axis is set at 45°–75°, fuel is smoothly atomized independently of the pressure difference between the inlet and the outlet of the air injection passages 36 and the injected air amount (see FIG. 10). However, it should be noted that fuel atomization due to air injection is notably obtained only when the fuel flows in a membrane-like pattern shown in FIG. 8.

As discussed above, in accordance with the present invention, since the a/d value is set at 0.2–0.3, a good fuel atomization characteristic is obtained. As a result, air pollution is suppressed and fuel economy is improved.

Although only one embodiment of the invention has been described in detail above, it will be appreciated by those skilled in the art that various modifications and alterations can be made to the particular embodiment shown without materially departing from the novel teachings and advantages of the present invention. Accordingly, it is to be understood that all such modifications and alterations are included within the spirit and scope of the present invention as defined by the following claims.

What is claimed is:

1. A fuel injection device for an internal combustion engine comprising:

a fuel injection valve having an axis and a fuel injection port, formed coaxially in the fuel injection valve, for injecting fuel; and an adapter coaxially coupled to the fuel injection valve, the adapter including:

a fuel dividing wall having a fuel collision surface at a top of the fuel dividing wall, the fuel collision surface being spaced from and coaxially opposite to the fuel injection port for causing fuel flowing from the fuel injection port toward the fuel collision surface to collide with the fuel collision surface to thereby divide the fuel into two portions, wherein the fuel collision surface is substantially flat and is oriented substantially perpendicular to the axis of the fuel injection valve;

two branch ports, formed on opposite sides of the fuel dividing wall, for allowing the fuel divided by the fuel collision surface of the fuel dividing wall to pass through the branch ports; and two air injection passages, each having an axis extending downwardly and inwardly, for injecting air from above against the fuel passing through the branch ports to promote atomization of the fuel, wherein the following relationship holds between a width a of the fuel collision surface and a diameter d of the fuel injection hole:

$$0.2 \leqq a/d \leqq 0.3$$

and wherein the following relationship holds for an angle $\theta$ defined between the axis of each air injection passage and the axis of the fuel injection valve;

$$45° \leqq \theta \leqq 75°.$$

2. A fuel injection device for an internal combustion engine according to claim 1, wherein the adapter further includes a concave portion defining a dead space with a bottom beneath the fuel injection port, the two branch ports opening to the dead space at the bottom of the dead space, and the fuel collision surface being downwardly spaced from the bottom of the dead space.

3. A fuel injection device for an internal combustion engine according to claim 2, wherein the dead space has a side surface with a circular transverse cross section and a bottom with a conical longitudinal cross section, and each of the two branch ports has a circular transverse cross section.

4. A fuel injection device for an internal combustion engine according to claim 1, wherein each of the two air injection passages opens into each of the two branch ports.

5. A fuel injection device for an internal combustion engine according to claim 2, wherein each of the two air injection passages opens into each of the two branch ports at a location downstream of the bottom of the dead space.

* * * * *